United States Patent [19]

Hammond

[11] Patent Number: 4,503,811

[45] Date of Patent: Mar. 12, 1985

[54] METHOD AND APPARATUS FOR REMOVING DEPOSITS FROM HIGHLY HEATED SURFACES

[75] Inventor: Charles W. Hammond, Lancaster, Ohio

[73] Assignee: The Babcock & Wilcox Company, New Orleans, La.

[21] Appl. No.: 543,784

[22] Filed: Oct. 20, 1983

Related U.S. Application Data

[63] Continuation of Ser. No. 335,556, Dec. 29, 1981, abandoned.

[51] Int. Cl.[3] ..... F22B 37/52

[52] U.S. Cl. ..... 122/392; 15/104.04; 122/382; 122/405; 134/168 C; 134/172; 134/198; 165/95; 239/101; 239/245; 239/450; 239/550; 239/554

[58] Field of Search ..... 122/379, 381, 382, 383, 122/384, 390, 392, 405; 239/101, 243, 245, 450, 549, 550, 554; 15/316 R, 316 A, 104.04, 317; 134/167 C, 168 C, 172, 198; 165/95

[56] References Cited

U.S. PATENT DOCUMENTS

| | | | |
|---|---|---|---|
| 3,661,124 | 5/1972 | Winkin | 239/549 |
| 3,664,310 | 5/1972 | Locke, Sr. et al. | 122/379 |
| 3,701,341 | 10/1972 | Willis, Jr. | 122/392 |
| 3,782,336 | 1/1974 | Nelson | 122/379 |
| 3,810,417 | 5/1974 | Sieke | 137/624.13 |
| 4,135,534 | 1/1979 | Autelli | 165/95 |
| 4,273,076 | 6/1981 | Laboda et al. | 122/382 |
| 4,276,856 | 7/1981 | Dent et al. | 122/382 |
| 4,346,674 | 8/1982 | Merritt, Jr. | 122/390 |
| 4,399,773 | 8/1983 | Schwade et al. | 122/390 |
| 4,422,882 | 12/1983 | Nelson et al. | 122/390 |

OTHER PUBLICATIONS

Publication "Impulse Technology", Date and Author Unknown (4 pp.) Published by Pickwell, F.A.I. Ins. Bldg., 619 Pacific Highway, St. Leonards 2065, N.S.W. Australia.

*Primary Examiner*—Edward G. Favors
*Assistant Examiner*—Steven E. Warner
*Attorney, Agent, or Firm*—Harness, Dickey & Pierce

[57] ABSTRACT

A method and apparatus for deslagging boilers and the like while steaming, wherein a quenching-type stream of water is first applied to the outer surface of the hot slag to induce the formation of fissures by embrittlement and contraction of the slag and thereafter while the fissures are still present the fissured surface of the slag is impacted by a high velocity pulsed jet which drives water into the fissures, whereby dislodging of the slag is aided by the expansive force of water which vaporizes in the fissures. A generally conventional blower is illustrated, equipped with dual liquid supply and projecting means, and pulsing mechanism for interrupting the flow of blowing medium to one of the projecting means, to create the pulsed jet.

2 Claims, 10 Drawing Figures

METHOD AND APPARATUS FOR REMOVING DEPOSITS FROM HIGHLY HEATED SURFACES

This application is a continuation of application Ser. No. 335,556, filed Dec. 29, 1981.

BACKGROUND OF THE INVENTION

Since the advent of high temperature water tube boilers which burn fuels having substantial slag content, and also with the adoption of certain high temperature processing-type heat exchangers, the removal of adherent deposits from the fire side surfaces has been an increasingly severe problem. Sootblowers employing jets of steam and/or air cannot remove some such deposits. It has long been known that jets of water can be used to assist in slag removal, and it was also understood for many years that the thermal shock and resultant embrittlement of the slag caused by a water jet, combined with the energy of the jet itself, could often dislodge slag not removable from a steaming boiler by other means. However, until the advent of the so-called constant jet progression system disclosed in U.S. Pat. No. 3,782,336 granted Jan. 1, 1974 to J. E. Nelson, it was frequently impractical to use water jets for this purpose, because it was not possible to control and limit the thermal shock to a value which would avoid premature failure of the tubes.

Although the aforementioned constant jet progression system employs a high velocity concentrated jet, and a considerable proportion of the water actually bounces off the tubes or slagged surfaces during the operation of that system, some chilling and embrittlement of the slag inherently result from the impingement of the jet, and some cracking may occur which assists the kinetic effect of the jet in dislodgment of the slag. The Nelson constant jet progression system, however, permitted such a reduction in the amount of water employed and of the amount of water which remained in contact with the tubes (or slag) while vaporizing, that the total amount of rapid heat extraction resulting from the chilling and latent heat of vaporization was, for the first time, reliably reduced to safe levels. In fact in normal use the Nelson system reduced the thermal shock effect to levels very much below the maximum which could be tolerated without danger of premature tube failure, and frequently no substantial or observable cracking of the slag occurred prior to its actual dislodgment.

The present invention aims to provide an improved method and apparatus whereby highly heated slag can be dislodged even more rapidly, by means involving accurate application of a controlled amount of thermal shock in conjunction with the kinetic energy derived from a separately applied pulsed high velocity jet.

A related object of the invention is to provide an improved system wherein a pulsed high velocity jet of water impacts the slagged surface while being moved thereover at a controlled rate of progression and wherein prior to being impacted by each pulse of such jet the increment of the surface which is to be impacted is first chilled to a limitd degree by a quenching stream which tends to cause fissures into which water is forced by the pulsed high velocity jet to promote dislodgment of the slag by expansion of water in the fissures.

Other objects and advantages of the invention will become apparent to persons skilled in the art upon consideration of the present disclosure in its entirety.

BRIEF DESCRIPTION OF THE FIGURES OF DRAWING

DETAILED DESCRIPTION OF PREFERRED FORM OF THE INVENTION

Figure 1:
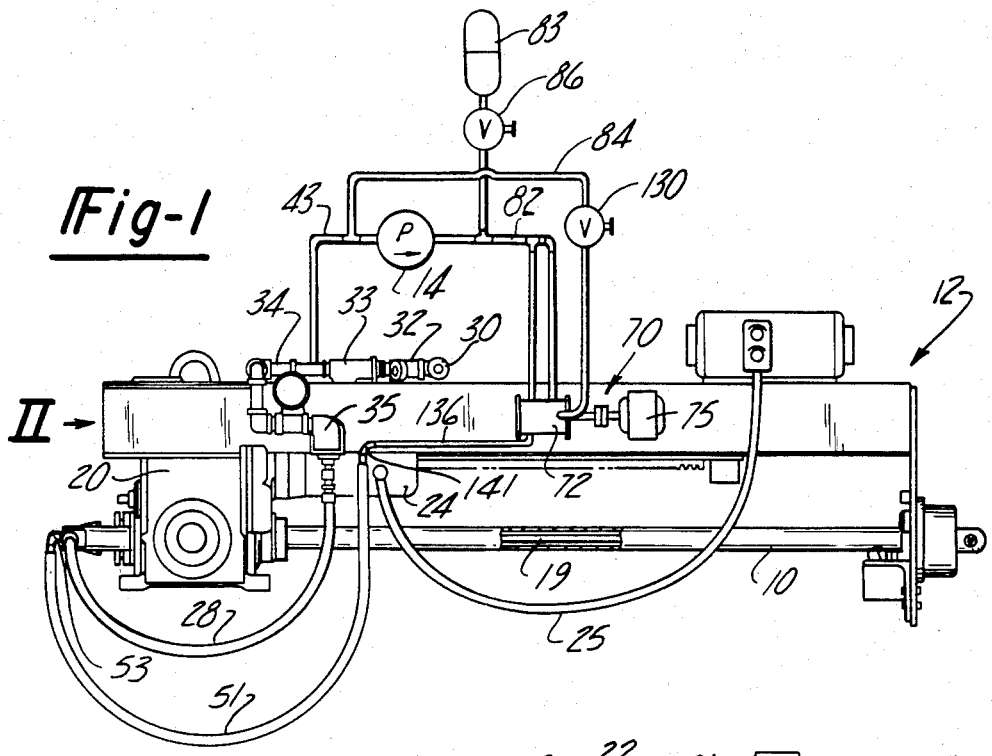
FIG. 1 is a somewhat diagrammatic side elevational view of a cleaning device employed in connection with and incorporating the principles of the present invention.
Figure 2:
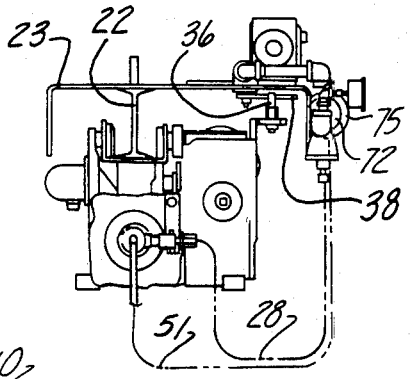
FIG. 2 is a rear elevational view taken as indicated by the arrow I in FIG. 1.

FIGS. 1 and 2 illustrate somewhat diagrammatically a long travel sootblower 12 which conforms generally to the construction of sootblowers of the well-known "IK" type, insofar as the construction of the beam and the carriage and actuating mechanism by means of which the lance tube 10 is adapted to be projected into the interior of the boiler during operation and retracted therefrom when the blower is inactive. Such blowers are designed to project a blowing medium (typically water, in the type of construction here under consideration) against the deposits (typically slag) which form on fire side surfaces in large boilers and other high temperature heat exchangers. Other types of blowers might be employed. The specific lance supporting and actuating means illustrated here is typical and does not in itself form a part of the present invention. Such details of blower mechanisms of the IK type are illustrated and described in detail in numerous U.S. and foreign patents including U.S. Pat. No. 2,668,978 to L. S. DeMart issued Feb. 16, 1954 and U.S. Pat. No. 3,439,376 to John E. Nelson et al issued Apr. 22, 1969.

As is typical with such blowers, an elongated lance tube 10 is adapted to be projected into and retracted from the interior of the boiler (the term "boiler" is used for convenience with the intent that it be construed to include other heat exchangers from which it is desired to remove deposits located on fire side surfaces). In the present instance the blower is designed to project two separate jets against the surface to be cleaned, as will be brought out in greater detail hereinafter, but as is typical in the case of so-called water lance blowers, when the lance tube is projected through and beyond the water wall area in a boiler, a nozzle (or nozzles, in the present instance) located near the end of the lance tube are effective to project the blowing medium angularly rearwardly against the inner slagged surface of the wall. Temperatures in such regions are typically substantially higher than 2000° F. (1,093.3° C.). While operating in the boiler the lance tube is moved angularly and axially so that depending upon whether the lance tube is rotated throughout a full 360°, or less than 360°, the jet will impact the slagged surface along a path in the form of a spiral or an interrupted spiral.

The lance tube 10 is rotatably supported at its rear end in the carriage 20, which is rollably mounted on the bottom flanges of an I-beam 22 which forms the main structural supporting member and which is shielded by a protective U-channel-type hood 23. A motor 24 on the carriage and which is energizable through a flexible power cable 25 contains suitable gearing (not shown) by means of which it actuates the carriage to move it and the lance tube along the I-beam and also rotate the lance tube. Such carriage constructions including the gearing and driving arrangements are well known and illustrated in the prior patents mentioned above, and will not require description here. The lance tube 10 comprises an outer tube 17, the distal end of which is formed as a nozzle block section 18, and an inner tube 19 of substantially smaller diameter and positioned in the outer tube 17 by means of radial supporting fins 21 which permit free flow of blowing medium through the portion of the outer tube outside the inner tube 19. A nozzle element 26 is supported in a cupped support 27 in the nozzle block 18 to receive blowing medium conducted through the outer tube 17 and discharge it at a slightly back-raked angle (e.g. 15 degrees) through an opening 29 in the nozzle block section 18, support 27 being peripherally welded and sealed to the area surrounding the opening 29.

Figure 3:
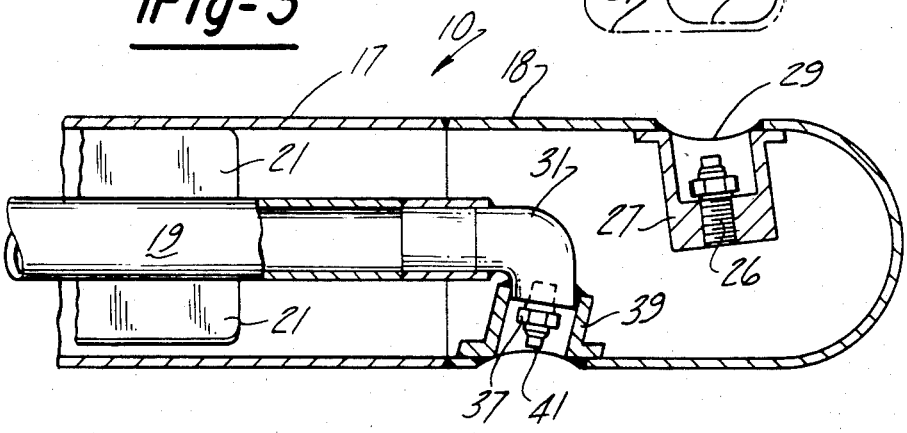
FIG. 3 is a diametric longitudinal sectional view on a larger scale of the nozzle portion of the lance tube.

Blowing medium conducted through the inner tube 19 flows through an elbow 31 to another nozzle 37 attached in similarly tightly sealed relation in the nozzle block. A sleeve 39 surrounds and isolates the nozzle 37 from the interior of the nozzle block section. The nozzle 37 discharges through an opening 41. As shown in FIG. 3, the nozzle 37 is similarly inclined rearwardly to discharge against a water wall in installations of the type mentioned.

It will be recognized that references to the cleaning of water walls are for the purpose of illustrating a useful application of the invention. Similarly it will be understood that the liquid blowing medium, although typically water, could be an aqueous solution containing a treatment medium. The liquid supply for delivery through the outer tube 17 and nozzle 26 is derived from a source of supply (not shown) which is connected to a fitting 30 and is conducted through a strainer 32 to a control valve 33. From the control valve 33 it is led, when the valve is open, through suitable piping 34 and connector 35 to the hose 28, which is rotatably connected to the rear end of the lance tube.

A branch pipe 43 connected to the piping 34 downstream from the valve 33 leads to pulsing mechanism generally designated 70 and which will be described in detail hereinafter. The pulsing mechanism delivers pulsed fluid via a pulsing output conduit 136, a second flexible hose 51, and a suitable rotatable connector 53 to the rear end of the radially inner lance tube 19.

The valve 33 is opened and closed by a lug 36 on the carriage. When the carriage moves forwardly from the retracted position shown in FIG. 1 to a position such that the nozzles are inside the boiler, the lug strikes a trip arm 38 to actuate the valve 33 to the ON position, while when the carriage returns, the lug strikes the trip arm to actuate the latter in the reverse direction to close the valve.

The blowing medium from nozzle 26 is employed as a preconditioning controlled chilling agent. The blowing medium from nozzle 37 is employed as an impacting mechanism. The pulsing means periodically interrupts the flow of fluid to the liquid discharged from nozzle 37 in such manner as to form sharply defined discrete pulses. The angular spacing of the nozzles 26 and 37 both axially of the lance tube and angularly about its periphery is such that during operation the nozzle 26 leads the nozzle 37 along the same path, so that the jet from the nozzle 26 strikes each increment of the impacted area a predetermined interval prior to the jet from the nozzle 37. The interval, and the flow from nozzle 26, are so related to the rate of progression of the jet over the surface to be cleaned that the liquid from nozzle 26 chills the slagged or fouled surface sufficiently to cause fissures to form in the slagged surface, but the interval permits the liquid from nozzle 26 substantially to dissipate from the chilled area before such area is struck by the pulsed jet. However, the interval is short enough so that the fissures still exist when the pulsed jet strikes the deposit. Some of the liquid content of the pulsed jet, which has a much higher peak impact pressure, is thus driven into the fissures, where its immediate evaporation creates a pressure beneath the surface which augments the effect of its kinetic energy in the dislodgment of the slag or fouling material.

As is known, the peak impact pressure of a pulsed jet can be as much as 50 times greater than that of a continuous jet. The quantity of water discharged from nozzle 26 in a steady stream can be relatively small, and at a lower pressure, so that it has a lesser tendency to bounce off the surface (as does a substantial proportion of the pulsed jet). The liquid from nozzle 26 provides a sufficient degree of wetting so that due to the high heat absorption derived from the latent heat of vaporization, cracking of the slag can be effected with a small amount of water. On the other hand, the pulsed fluid is delivered at very high pressure, and its impact is increased by pulsing, so that, again, a relatively small amount of water can be used, which due to its high kinetic energy and the shattering effect derived from the quenching or chilling stream from nozzle 26, removes the embrittled slag very efficiently, and a relatively small total amount of water is required for the two jets. Although as indicated the total amount of water is relatively small, each pulse of the jet from nozzle 37 contains a substantial mass which is capable of delivering a relatively high impact.

The carriage motor 24 is of the variable speed type, and its speed is controlled to regulate the rate of progression of the jet in such manner as to maintain it substantially constant, in the manner taught in Nelson U.S. Pat. No. 3,782,336, granted Jan. 1, 1974.

FIGS. 4–10 inclusive show a preferred pulsing mechanism for the liquid supply to nozzle 37. The pulsing unit, generally designated 70, consists of a rotary pulse generator, generally designated 72, and a motor 75. The pulsing unit is adapted to be mounted on the blower, as by attachment to the protective hood channel 23, as shown in FIG. 1.

The pulsing unit comprises a cylindrical body 74 suitably closed by end bearing caps 76, 77, from the latter of which the driving shaft 78 extends for connection to the shaft of the motor, which may be a conventional induction motor rotating at approximately 1800 rpm. The cylindrical chamber 85 in the body 74 contains a rotor 90 accurately fitted and rotatable therein and fast with respect to shaft 78. A diametric passage 91 of square cross section extends through rotor 90 near one end, shown at the left in FIG. 4, and when the shaft is rotated acts as a pulsing or interrupter valve, and at each half turn of the rotor provides connection between diametrically opposed square-sectioned pulsed fluid inlet and outlet ports 92, 93. Inlet port 92 is slightly larger in cross section than the passage 91 in the rotor. Outlet port 93 is the same size as passage 91.

Figure 4:
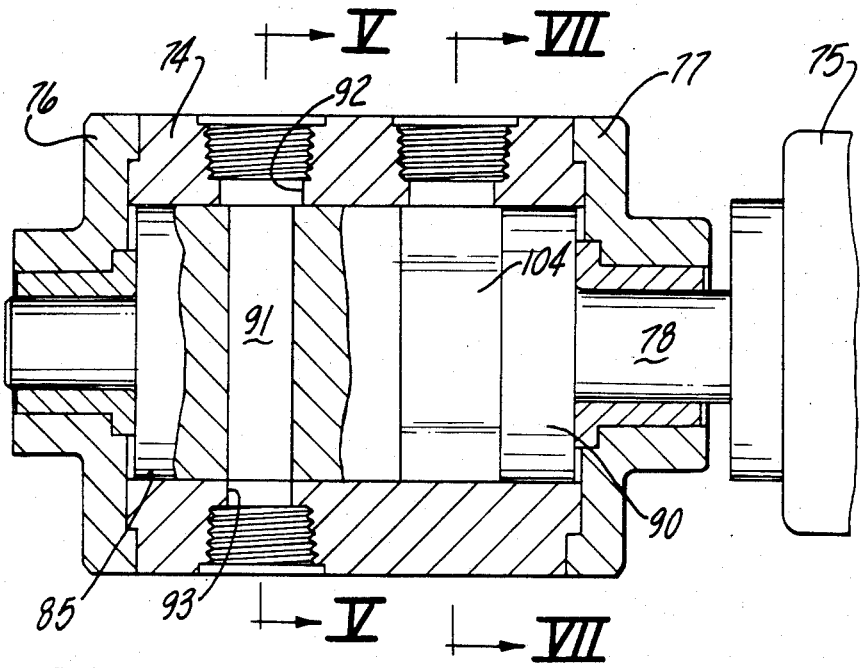
FIG. 4 is a somewhat diagrammatic view of the pulse generating means, partly in longitudinal section and partly in side elevation.
Figure 5:
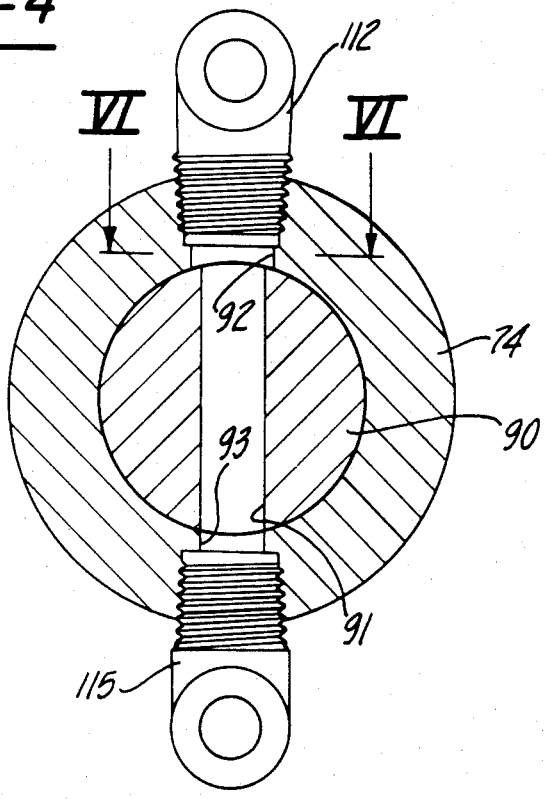
FIG. 5 is a cross sectional view taken substantially on the line V—V of FIG. 4 and looking in the direction of the arrows.
Figure 6:
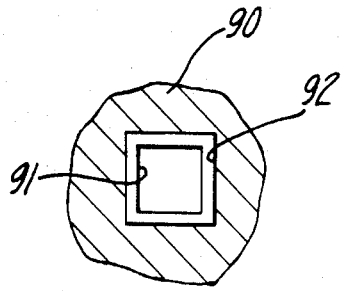
FIG. 6 is a detailed sectional view taken substantially on the line VI—VI of FIG. 5 and looking in the direction of the arrows.
Figure 7:
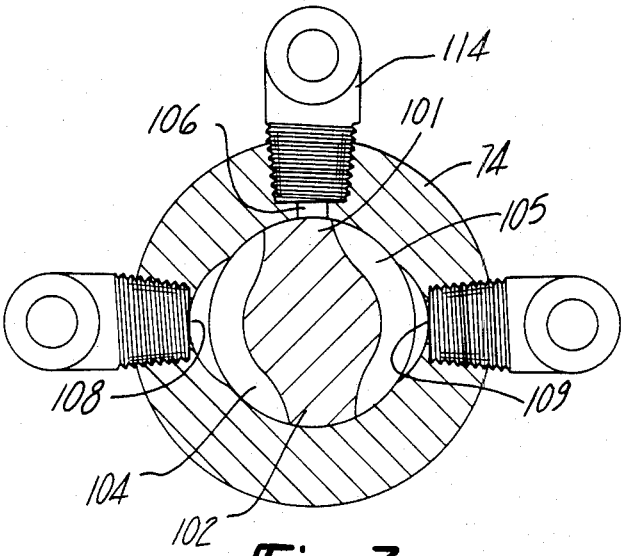
FIG. 7 is a detailed cross sectional view taken substantially on the line VII—VII of FIG. 4 and looking in the direction of the arrows.
Figure 8:
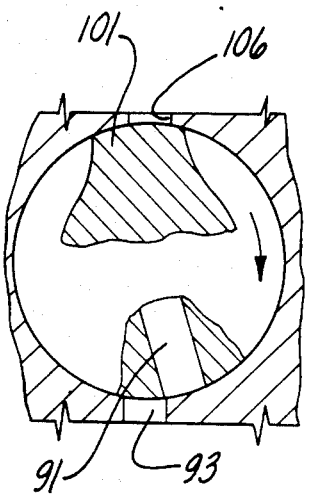
FIGS. 8, 9 and 10 are timing diagrams showing successive positions of components of the pulsing mechanism.
Figure 9:
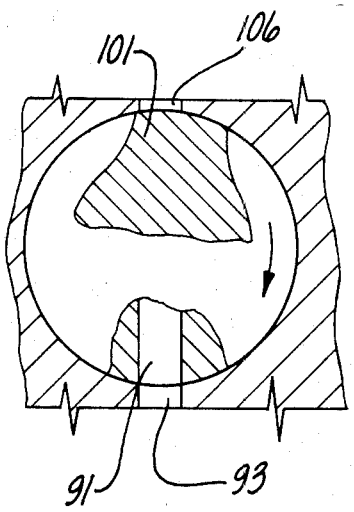
Figure 10:
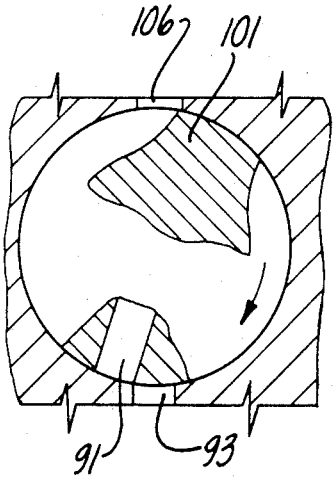

Near its right end (as shown in FIG. 4) the rotor is cut away in two diametrically opposed areas 104, 105 to create opposed lobe portions 101, 102 which rotate in alignment with and periodically block a bypass fluid inlet port 106 in the body 74 at each half turn of the rotor, forming a bypass or discharge valve which is actuated in timed relation to the pulsing valve. Two diametrically opposed bypass outlet ports 108, 109 extend through the wall of the housing 74 in transverse alignment with and at 90° to the bypass inlet port 106. Outlet ports 108, 109 are always in communication with inlet port 106 via clearance areas 104, 105, except when port 106 is obstructed by one of the lobes 101, 102. FIGS. 8–10 show the relative orientation of the lobes and of the passage 91 whereby the bypass inlet port 106 is blocked by one of the lobes 101, 102 whenever passage 91 provides communication between ports 92, 93.

Both of the ports 92 and 106 are connected as by suitable fittings 112, 114 to the supply of liquid under pressure, shown as delivered to both inlets of the pulsing means via a booster pump 14. An accumulator 83 may be connnected to pipe 82 via a manual valve 86 to enable controlling the peak surge pressure or "hammer" to any desired degree. The bypass discharge ports 108, 109 are shown as connected to the pulser supply pipe 43 upstream from the pump by pipe 84 which contains a manual valve 130 which enables a desired pressure drop to be imposed. It will be recognized that the bypass ports could, alternatively, discharge to atmosphere. The pulsed fluid from outlet 93 is conducted via pipe 136 to the connector 141 which supplies the inner lance tube 19 via hose 51 and connector 53.

In view of the strong peak impact augmentation effect of the pulsing mechanism, some installations may not require the use of a booster pump, depending upon the pressure of the available water supply and the severity of the slagging condition.

By virtue of the square contour of the passage 91 and of the ports 92, 93, the front and rear faces of which are perpendicular to the direction of rotation, and due to the rapid rotation of the rotor, the flow to the inner lance tube and its nozzle 41 is started and cut off quickly and fully, to form discrete pulses without substantial taper at either end. More precisely, it will be recognized that the word "square" merely refers to a covenient form of rectangle, and that in fact the feature in question does not specifically depend upon a rectangular cross section, but results from the fact that the surfaces which lie at positions corresponding to the leading and following surfaces of the rotating mass of liquid are flat and substantially perpendicular to a line tangent to a circle described by a point on the rotor.

The lobes 101, 102 are somewhat wider than the bypass inlet port 106 so that, as brought out in FIG. 8, the bypass is closed slightly prior to the opening of pulse outlet port 93, thereby causing a pressure build-up which creates an increase in the peak pressure at the start of the pulse.

This detailed description of the preferred form of the invention, and the accompanying drawings, have been furnished in compliance with the statutory requirements to set forth the best mode contemplated by the inventor of carrying out the invention. The prior portions consisting of the "Abstract of the Disclosure" and the "Background of the Invention" are furnished without prejudice to comply with administrative requirements of the Patent and Trademark Office.

While a preferred form of the invention has been illustrated and described, it will be recognized that changes may be made within the fair and reasonable scope of the appended claims without departing from the properly patentable scope of the invention.

What is claimed is:

1. Means for dislodging an adherent highly heated slag-like deposit which is at a temperature above the boiling point of water from the heated area of a heat exchanger or the like, comprising a water lance having a plurality of isolated water passages extending longitudinally therethrough and having a portion including a free end, said portion being movable into and retractable from the heat exchanger, a plurality of nozzles carried by said portion of the lance in longitudinally spaced relation including a first nozzle connected to a first one of said passages and a second nozzle connected to a second one of said passages, said second nozzle being farther from the free end than the first nozzle, means for delivering an uninterrupted flow of water under pressure through said first one of said passages for projection in the form of a jet from the first nozzle, means for delivering a flow of water under pressure through said second one of said passages for projection in the form of a jet from the second nozzle, means for periodically interrupting the flow from said second nozzle to break the jet from said second nozzle into pulses which develop a higher peak impact pressure than the jet from the first nozzle, and means for moving the lance in a longitudinal pattern such that said nozzles successively trace a same predetermined path to form an area of fissures in the deposit, whereby portions of said deposit along said path are successively contacted first by the jet from said first nozzle and then by pulses from said second nozzle, and at a speed so related to the spacing of the nozzles, and to the rate of vaporization of the water, and to the temperature of the slag, that the pulses from the second nozzle strike the fissured area after the water has evaporated from the fissures but while fissures are still present in the deposit.

2. Means as set forth in claim 1 including means for moving the lance simultaneously both longitudinally of and angularly about is longitudinal axis, said nozzles being so spaced from each other both longitudinally and angularly that the nozzles move successively along the same path.

* * * * *